US005180018A

United States Patent [19]

Taylor

[11] Patent Number: 5,180,018

[45] Date of Patent: Jan. 19, 1993

[54] SPLIT STACK FIRE-FIGHTING APPARATUS AND PROCESS OF USE

[76] Inventor: Robert E. Taylor, 2929 Claremont Rd., Shaker Heights, Ohio 44122

[21] Appl. No.: 706,887

[22] Filed: May 29, 1991

[51] Int. Cl.[5] ..... A62C 3/06

[52] U.S. Cl. ..... 169/47; 169/48; 169/52; 169/69

[58] Field of Search ..... 169/69, 43, 47, 48, 169/52

[56] References Cited

U.S. PATENT DOCUMENTS

| | | | |
|---|---|---|---|
| 910,295 | 1/1909 | Layne | 166/79 |
| 1,520,288 | 12/1924 | Featherstone | 169/49 |
| 1,758,453 | 5/1930 | Mays | 166/79 |
| 1,830,061 | 11/1931 | Howe | 169/69 X |
| 3,463,227 | 8/1969 | Smith | 166/90 |
| 3,730,278 | 5/1973 | Roy | 169/49 |
| 4,895,205 | 1/1990 | Thompson et al. | 166/90 |

OTHER PUBLICATIONS

Boone, Andrew R., "What Happens When A Gasser Blows In When an Oil Well is Being Drilled", *Scientific American*, Jun. 1932, pp. 326-399.

*Primary Examiner*—Charles A. Marmor
*Assistant Examiner*—Andrew C. Pike
*Attorney, Agent, or Firm*—Watts, Hoffmann, Fisher & Heinke Co.

[57] ABSTRACT

In an apparatus and process for extinguishing the fire of an escaping flow of fossil fuel, such as from an oil or gas well, the preferred apparatus comprises a boom-held, open-ended, split stack equipped with quench fluid outlets on its inside and structure for spreading the stack and closing it around the flame to confine and operate on the flame front. The process involves closing such stack around the flame, preferably with the quench fluid flowing from the opened-up stack as it approaches the fire, then continuing such flow until the fire goes out and the fuel vapors and equipment in the former flame zone are below autoignition temperature.

17 Claims, 3 Drawing Sheets

SPLIT STACK FIRE-FIGHTING APPARATUS AND PROCESS OF USE

This invention relates to a fire-fighting apparatus and process, and, more particularly, to such subject matter where an extinguisher (quench fluid) is played onto a flame of escaping fossil fuel, e.g. from an oil or gas well.

BACKGROUND OF THE INVENTION

Television recently has shown some very hazardous attempts to extinguish oil well fires in Kuwait. There, stack-like objects were lowered over the flame of a flaming oil well, then water poured into the top of the stack, but not always with the intended extinguishing effect. Earlier attempts to arrest fires at petroleum and gas well include: the preventive installation of an upright, open-top housing mounted around the top of the well pipe, the housing having internally an introduction of extinguishers such as water (U.S. Pat. No. 3,463,227); a conical cap-like device to be set over a flaming wellhead, the device having a releasable chemical and inlet water for the extinguishing (U.S. Pat. No. 1,520,288); and floatable safety enclosure with a small top opening for surrounding and doming over an off-shore oil rig (U.S. Pat. No. 3,730,278); vehicle-borne well-capping and flow-diverting apparatus with a feeding in of flame-smothering material such as water (U.S. Pat. No. 1,758,453); and vehicle-mounted well-capping apparatus with a diverter pipe and an escape pipe while installation proceeds, these pipes being supplied with steam or other extinguishing vapor if needed (U.S. Pat. No. 910,295). It also has been proposed to wash a drill pipe with water sprays disposed in a jacket around the pipe (U.S. Pat. No. 4,895,205).

A basic anatomy of a flaming petroleum oil or gas jet is an outer flame with its burning vapor front ("flame front") surrounding and feeding off hydrocarbonaceous vapors, and those overlying an inner body of liquid oil if the hydrocarbon flow is liquid phase-continuous. The flame can be extinguished by depriving it of fuel and/or oxygen and/or its kindling temperature level. If the zone of the fire and its fuel supply then is cooled to a temperature below the autoignition temperature of the fuel, the flame is unlikely to be rekindled.

BROAD STATEMENT OF THE INVENTION

Advantages of the instant invention over prior proposals include more facile and controllable access to the fire, improved protection of the equipment, particularly the "hot end" thereof (i.e. nearest the flame), and the potential for efficient use of extinguishant (quench fluid), e.g. water, steam, and/or air, and also aqueous foam, thickened (cohesive) water, sand and/or some earth slurries, and liquid nitrogen.

One aspect of the invention is a process for extinguishing the fire of an escaping flow of fossil fuel which is burning with a generally upwardly-extending flame, the process comprising:

closing the sections of an open-ended stack around said fuel flow, thereby forming a confined zone that surrounds said flame front laterally, injecting a flux of quench fluid throughout said zone from apertures inside said stack that are disposed around the flame front; and establishing and maintaining the flux rate of the quench fluid sufficiently high to extinguish the fire.

Preferably, the length of the confined zone thus established is sufficient to preclude the re-ignition of fuel vapors above and below it after the flame has been extinguished.

Another aspect of the invention is apparatus for extinguishing the fire of an escaping flow of fossil fuel which is burning with a generally upwardly-extending flame, the apparatus comprising:

a stack comprising sections, at least a portion of which sections can be spread apart, then closed to surround and confine laterally the flame front of the fire, the stack having an open top, an open bottom, and quench fluid inlet means, the stack interior being equipped with a plurality of quench fluid outlets disposed for blanketing the confined flame front;

means for spreading open the stack and closing it around said flame front; and a boom for disposing the stack near flame front of the fire.

BRIEF DESCRIPTION OF THE DRAWINGS

FIGS. 5 and 6 are diagrammatic elevational perspective views of such stacks.

BEST MODE FOR CARRYING OUT THE INVENTION

Figure 1:
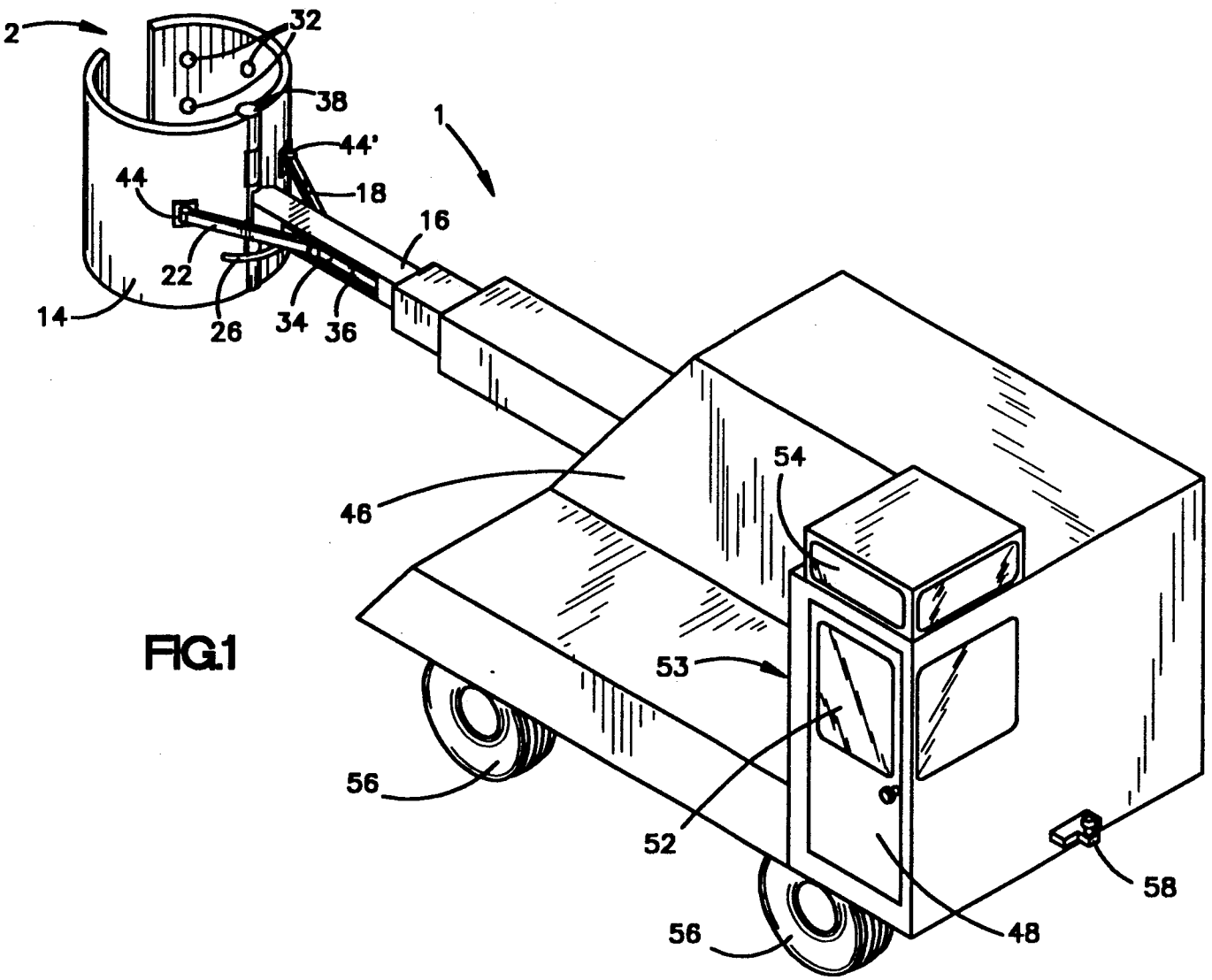
FIG. 1 is an isometric view of a preferred split stack apparatus.
Figure 2:
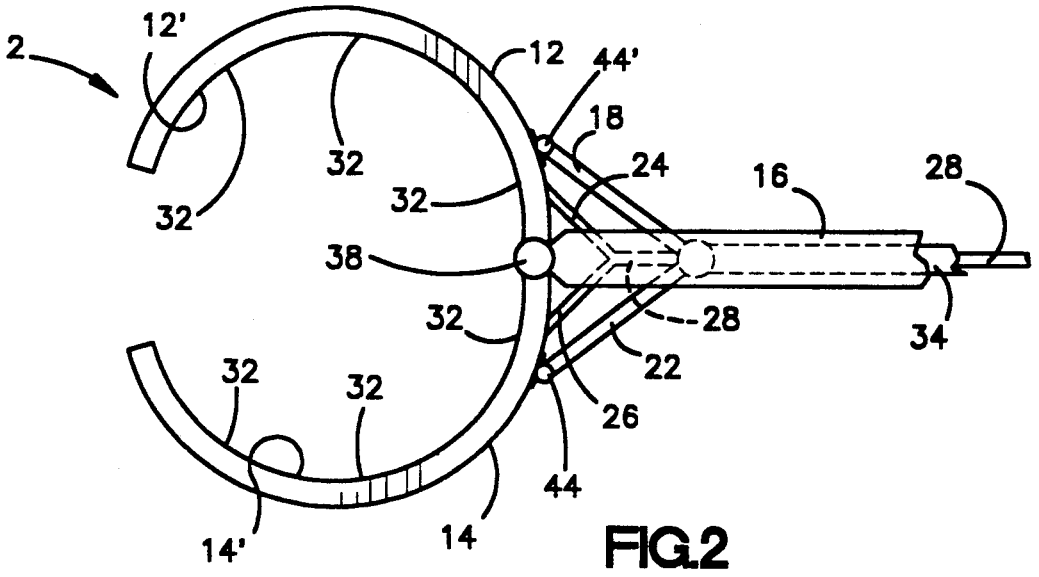
FIG. 2 is a fragmentary top plan view of the preferred split stack fire-fighting apparatus of FIG. 1.
Figure 3:
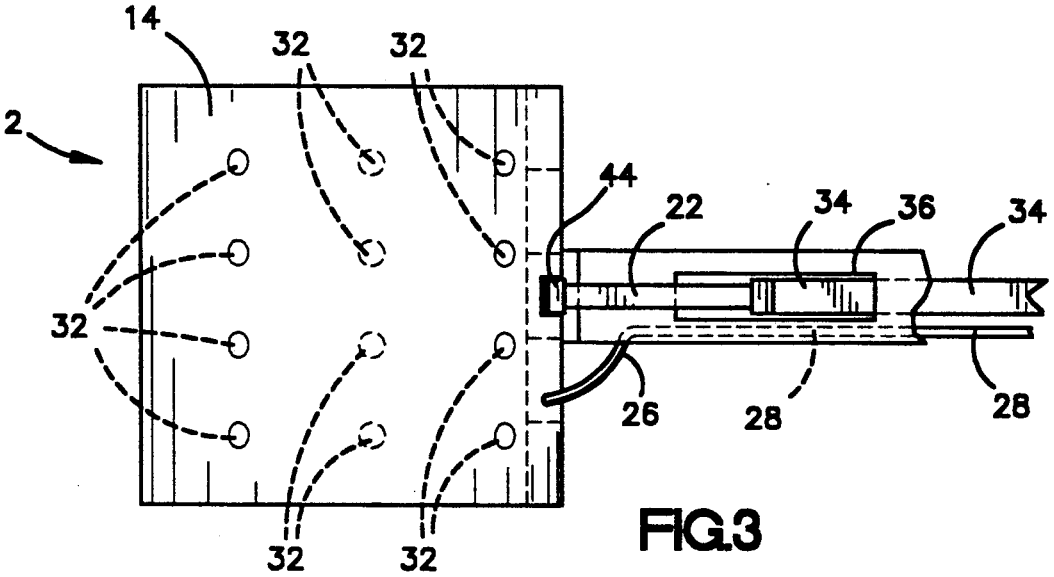
FIG. 3 is a fragmentary side elevation of the stack apparatus of FIG 2.
Figure 4:
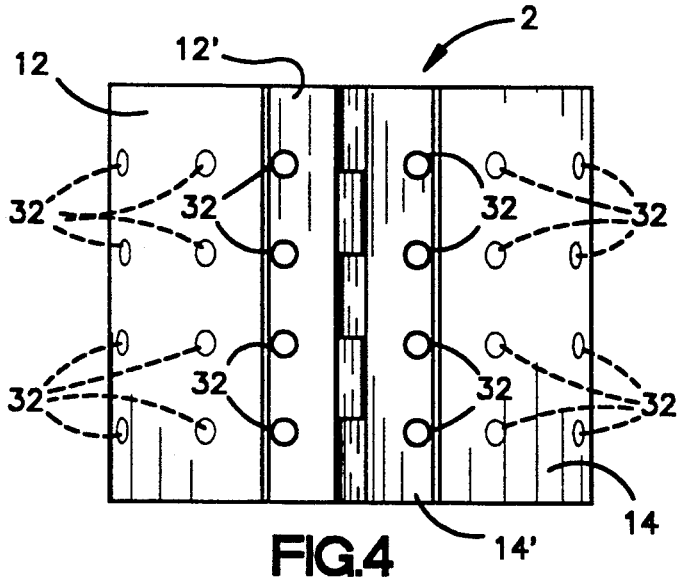
FIG. 4 is a fragmentary frontal elevation of the stack apparatus of FIG. 2.

Referring to FIGS. 1, 2, 3, and 4, arrow 1 denotes generally an apparatus for fire-fighting. The split stack, noted generally as arrow 2, is made up of left half 14 and right half 12 hinged together by hinge 38 and held out vertically by the end of the boom 16. Each half, 12 and 14, comprises, in effect, a water jacket. The inner sides 12' and 14' of the stack halves are equipped with a plurality of water spray nozzles 32 aimed inwardly toward the vertical axis of the closed stack 2. Behind inner walls 12' and 14' is space for quench fluid, such as water, jacketed in by the outer walls of halves 12 and 14 and feeding quench fluid to the nozzles 32. Items 44 and 44' are pivoting arm joints.

The quench fluid supplied to the inside of the halves 12 and 14 by lines 24 and 26, and that quench fluid being expelled through nozzles 32, protects this hotend stack 2 from the heat of the fire being operated on, particularly when the flow of extinguishant is initiated before the stack is moved in the near zone of the fire and is closed around a flaming jet of the oil or gas well (or a jet from other equipment or piping.)

Thus, from nozzles 32 sprays of liquid water or, in lieu thereof, fresh or saline water atomized by intersecting jets of steam, air and/or more liquid water and/or flows of water simply from orifices in the inner walls 12' and 14' of stack 2, act to extinguish the fire. When the flame is quenched, this quench fluid flux or part of it may be continued to cool the drill pipe and former flame zone generally and to get fuel vapors and immediate apparatus down to a temperature below that where autoignition of such vapors might occur. Conduits 24 and 26, supplied with extinguishant (quench fluid) from piping 28 inside the boom 16 (and ultimately from pumps and tanks not shown on vehicle 46 and/or from other sources not shown), deliver the extinguishant to the jacketing of sides 12 and 14, respectively, for the spray nozzles 32.

Usually, the fire is approached with the boom 16 retracted and the stack 2 wide open at its front. The vehicle 46 then is halted, the boom extended, and the arm operating rod 34 moved forward in slot 36 to actuate the pivotable arms 18 and 22 to close the front of the stack 1 which is hinged by hinge 38. Desirably, when the vehicle is halted in this sequence, the flow of extinguishant is started to protect the open stack 1 as it is advanced to surround and then close in on the fire. The boom can be raised and lowered and swung from side to side, as well as extended and retracted. It can also be rotated at least about 90° on its long axis. Accordingly, the stack on the boom end correspondingly can be advanced and retracted, raised and lowered, swung to the left and right, and tilted either way from the vertical.

The boom 16 extends outwardly from vehicle 46, a heat-shielded truck, equipped with wheels 56, operator's cab door 48, cab windows 52 and 53, cab top window 54, and hitch 58 (for attaching and drawing additional gear not shown, such as tanks of liquid on wheels or sledge, and/or an extra power plant, pumps, etc). The front, top, and sides of vehicle 46 may be a heat-resistant hard board. Aboard the vehicle 46 but not shown, may be a conventional automotive power plant, driving, braking and steering apparatus, pumping, blowing, and foam-generating equipment, boom and stack-operating apparatus and controls and the usual equipment for the operator to drive the vehicle 46, open and close the stack 2, extend and withdraw the boom 16, tilt the cylindrical stack 1 away from the vertical, quench fluid piping and controls, and facilities for operator's comfort such as air-conditioning equipment and power-assisted control equipment.

Figure 5:
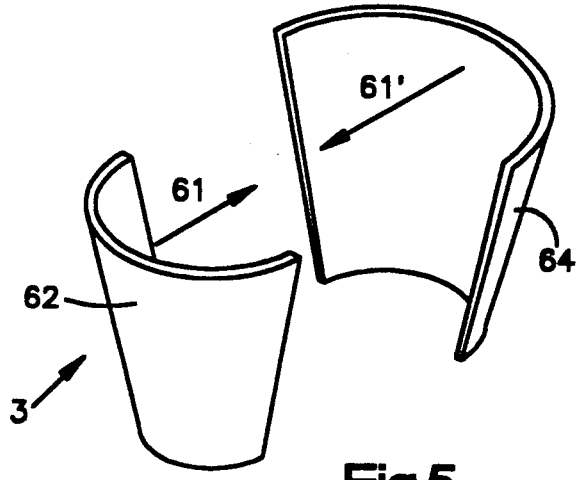
FIGS. 5 and 6 show diagrammatically the conformation of several alternative stacks for mounting on booms like the stack of FIG. 1.
Figure 6:
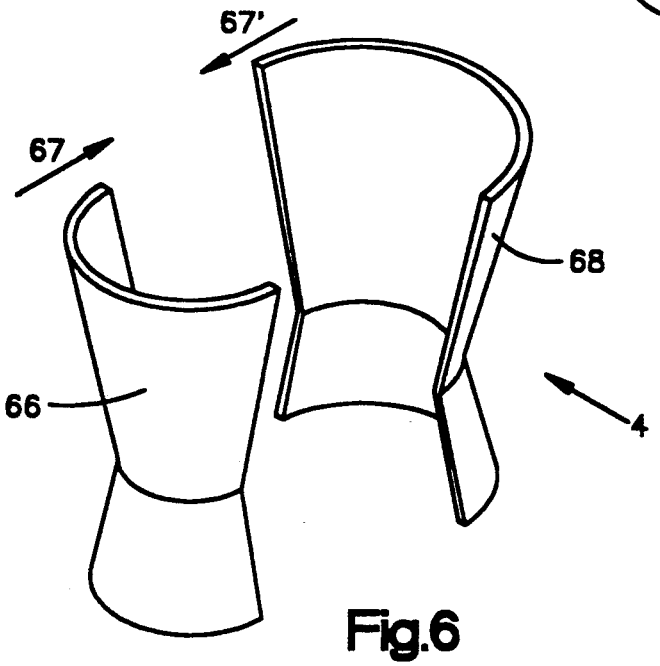

Referring now to FIGS. 5 and 6, the elevational perspective view of the stack 3 is inverted frustoconical while that of stack 4 is the joined frustra of two cones. Closing halves 62 and 64 of stacks 3 and halves 66 and 68 of stack 4 around the flame front with their smallest parts at or below the base of the flame may be helpful to handle the vast vapor volumes generated in the extinguishing of the fire, particularly in the initial stages of the fire-fighting. The arrows 61 and 61' and 67 and 67' simply indicate that both sides of stacks 3 and 4 move towards each other to close, either being hinged or sepated, then moved into a stack-forming engagement. The stack apparatus diagrammed in FIGS. 5 and 6 may be equipped and employed like that shown for stack 2 of the earlier figures.

Typically a drill pipe of the flaming well is 3 to 4 inches in diameter, and some are as large as 6 inches in diameter. The burning vapor front (flame front) normally will be very thin, e.g. 0.003 inch thick. The flame around it will extend out and usually upward. A diameter of at least 2 feet and preferably 3–6 feet is preferred for a cylindrical stack here; a like diameter at the base of a conical stack such as that of FIG. 5 or at the constriction of a double frustoconical stack like that of FIG. 6 is preferred for such conical types. The stack need not, however, be conical or cylindrical; it can be pyramidal or prismatic, if desired, or have arcuate walls, e.g. like a venturi apparatus.

The length of the stack generally will be at least 2 feet and preferably will be at least 4–8 feet and can be longer. The longer length can act to preclude quite positively any re-ignition of fuel vapors above or below the stack after the fire is out. The zone of flame front confinement should reach at least from the base of the flame front to its top to be especially sure of precluding re-ignition. Water is a preferred quench fluid, and even saline water can be used. However, fresh water is preferred because of the corrosive nature of saline liquids. Similarly aqueous sand and earthen slurries (preferably devoid of combustible matter) can be used as quench fluids, but these tend to abrade orifices, pumps, etc. Thickened water can be excellent because of its cling, etc., and aqueous foams also are useful here because of their surface area per unit weight. Air itself may help blow a flame away from its source of vapor fuel and to cool things somewhat, as well as act to entrain water and other extinguishants and so can steam. Thus, these vapors are useful as quench fluids. The instant invention can, of course, be applied to leaks in natural gas and oil pipe lines, manifolds, etc., as well as to wells.

Many modifications and variations of the invention will be apparent to those skilled in the art in the light of the foregoing detailed disclosure. Therefore, it is to be understood that, within the scope of the appended claims, the invention can be practiced otherwise than as shown and described.

I claim:

1. A process for extinguishing a fire of an escaping flow of fossil fuel which is burning with a generally upwardly-extending flame front around said flow, the process comprising:

disposing an open-ended stack comprising two vertically hinged sections near said flame front, said stack having inside walls, pivoting said two sections about a vertical hinge therebetween thereby closing said two sections of said stack around said fuel flow, thereby forming a confined zone that surrounds said flame front laterally, injecting a flux of quench fluid throughout said zone from a plurality of apertures that are disposed in said inside walls around the flame front laterally, and establishing and maintaining the flux of the quench fluid at a rate sufficiently high to extinguish the fire.

2. The process of claim 1 wherein the quench fluid includes an aqueous liquid, the flux of it is started before closing up said sections, and the confined zone is sufficient to preclude re-ignition of fuel vapors above and below said zone after the fire has been extinguished.

3. The process of claim 2 wherein the quench fluid comprises thickened water.

4. The process of claim 2 wherein the quench fluid comprises an aqueous foam.

5. The process of claim 1 wherein the quench fluid includes steam.

6. The process of claim 1 wherein the quench fluid includes air.

7. The process of claim 1 wherein the quench fluid carries solid particles with it.

8. The process of claim 7 wherein said solid particles include sand.

9. The process of claim 1 wherein the fuel flow is mainly natural gas output from a well.

10. The process of claim 1 wherein the fuel flow is mainly petroleum oil output from a well.

11. Apparatus for extinguishing a fire of an escaping flow of fossil fuel which is burning with a generally upwardly-extending flame front around the flow, the apparatus comprising:

a stack comprising at least two vertical sections that are vertically hinged for opening and closing said sections, wherein said two sections can be spread apart, then closed to surround and confine laterally the flame front of the fire, the stack having an open top, an open bottom, an interior and quench fluid inlet means, the stack interior being equipped with a plurality of quench fluid outlets disposed for blanketing the confined flame front;

means for spreading open the stack and closing the stack around said flame front; and a boom for disposing the stack near the flame front of the fire.

12. The apparatus of claim 11 wherein the stack is essentially columnar.

13. The apparatus of claim 12 wherein the stack is flared in a direction of said open top.

14. The apparatus of claim 13 wherein the stack comprises a frustoconical section and is widest at the top.

15. The apparatus of claim 11 wherein the stack is substantially cylindrical.

16. The apparatus of claim 11 wherein the boom extends from a movable base and the base is shielded from heat.

17. The apparatus of claim 16 wherein the base comprises at least one vehicle.

* * * * *